US006105267A

United States Patent [19]

Hathaway

[11] Patent Number: 6,105,267

[45] Date of Patent: Aug. 22, 2000

[54] ADJUSTABLE CARPENTRY ANGLE APPARATUS

[76] Inventor: Glenn T. Hathaway, 19 Third St., Attleboro, Mass. 02703

[21] Appl. No.: 09/195,520

[22] Filed: Nov. 18, 1998

Related U.S. Application Data

[63] Continuation-in-part of application No. 08/789,930, Jan. 28, 1997, abandoned.

[60] Provisional application No. 60/010,937, Jan. 31, 1996.

[51] Int. Cl.[7] ..... B43L 7/10

[52] U.S. Cl. ..... 33/465; 33/464; 33/471

[58] Field of Search ..... 33/460, 463, 464, 33/465, 471, 472, 473, 461, 419, 459, 462

[56] References Cited

U.S. PATENT DOCUMENTS

| | | | |
|---|---|---|---|
| 223,727 | 1/1880 | Halley | 33/419 |
| 369,499 | 9/1887 | Billings | 33/473 |
| 735,128 | 8/1903 | Murphy | 33/472 |
| 847,720 | 3/1907 | Barbo | 33/462 |
| 899,692 | 9/1908 | Clark | 33/471 |
| 1,366,878 | 1/1921 | Curry | 33/473 |
| 2,140,098 | 12/1938 | Weiskoff | 33/419 |
| 2,332,347 | 10/1943 | Schaefer et al. | 33/461 |
| 4,955,141 | 9/1990 | Welch | 33/471 |
| 5,414,938 | 5/1995 | Meek | 33/464 |

*Primary Examiner*—Christopher W. Fulton
*Attorney, Agent, or Firm*—John A. Haug

[57] ABSTRACT

A tool (10,10',10") for forming and applying an adjustable, selected angle to one or more pieces (8) of building material such as sheet rock, plywood, paneling or the like is shown comprising a first leg (12,12',12") having a longitudinally extending slot (34,54) pivotably attached to a second leg (20) with a connecting link (30) pivotably attached to the second leg and slidably and lockably attached in the slot (34,54) of the first leg (12,12',12")

4 Claims, 5 Drawing Sheets

ADJUSTABLE CARPENTRY ANGLE APPARATUS

CROSS REFERENCES TO RELATED APPLICATIONS

This is a continuation-in-part of U.S. application Ser. No. 08/789,930, filed Jan. 18, 1997, now abandoned which claimed priority on provisional application Ser. No. 60/010,937, filed Jan. 31, 1996.

FIELD OF THE INVENTION

This invention relates generally to carpentry and more particularly to a tool for use in marking one or more construction pieces along any selected angle for cutting along such angle.

BACKGROUND OF THE INVENTION

During the construction of a building there are many occasions where a plurality of pieces, such as sheets of sheet rock, have to be cut along a selected angle, for example along a line to match a roof-line which forms a selected angle, such as 30 degrees with the horizontal. Conventionally this is done by taking specific measurements at locations of the structure where the piece is to be attached corresponding to the two extremities of each piece, marking these points on the piece and drawing or striking a guide mark between the points and then cutting the piece along the mark. This process is repeated with each piece to be placed contiguous with the roof-line. Not only is this a time consuming task but the possibility of making errors increases with each separate step concomitantly with the possibility of wasting material due to such errors. Since labor comprises a large proportion of the total cost of construction, it would be very desirable to decrease time involved in tailoring various component parts of the building as well as to minimize loss of material due to errors in taking and transferring measurements to the construction materials to be cut.

SUMMARY OF THE INVENTION

It is an object of the present invention to overcome the limitations of the prior art noted above. Another object is the provision of apparatus to aid in reliably applying a mark having a selected angle relative to a reference, such as horizontal or vertical, to a plurality of construction material items, for example, plywood sheets, paneling, vinyl siding or the like. Still another object is the provision of a simple, inexpensive yet reliable tool which can be used to accommodate any given angle and to apply that angle to any selected number of pieces.

Briefly, a tool made in accordance with the invention comprises first and second elongated legs pivotably connected together at one end of each leg and being provided with a connecting link, one end of which is pivotably connected to one elongated leg at a location intermediate the ends thereof and with an opposite end slidably connected to the other elongated leg through a slot which extends substantially along the entire length of the other leg. According to a feature of the invention the slidable connection of the connecting link to the said other elongated leg includes a threaded member which extends from the said opposite end of the connecting link through the slot. According to a feature of the invention an indexing means comprising a pair of bores is formed along the slot at locations corresponding to at least one selected angle.

Additional objects and features of the invention will be set forth in part in the description which follows and in part will be obvious from the description. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. In the drawings.

DETAILED DESCRIPTION OF THE PREFERRED EMBODIMENTS

Figure 1:
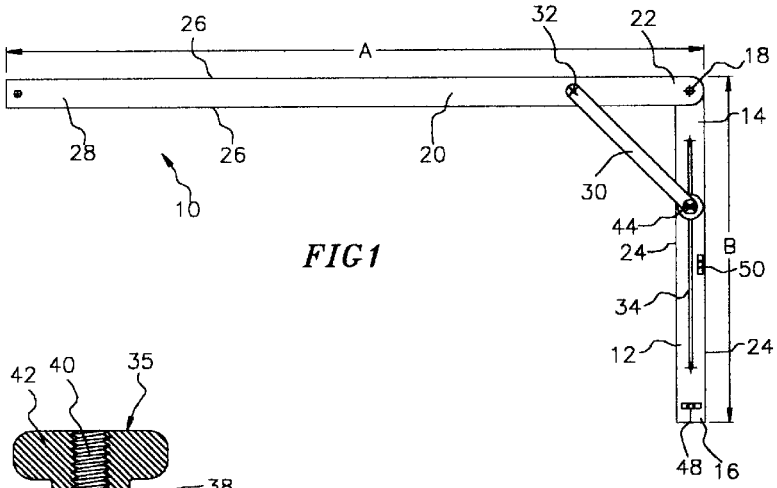
FIG. 1 is a top plan view made in accordance with the invention.
Figure 2:
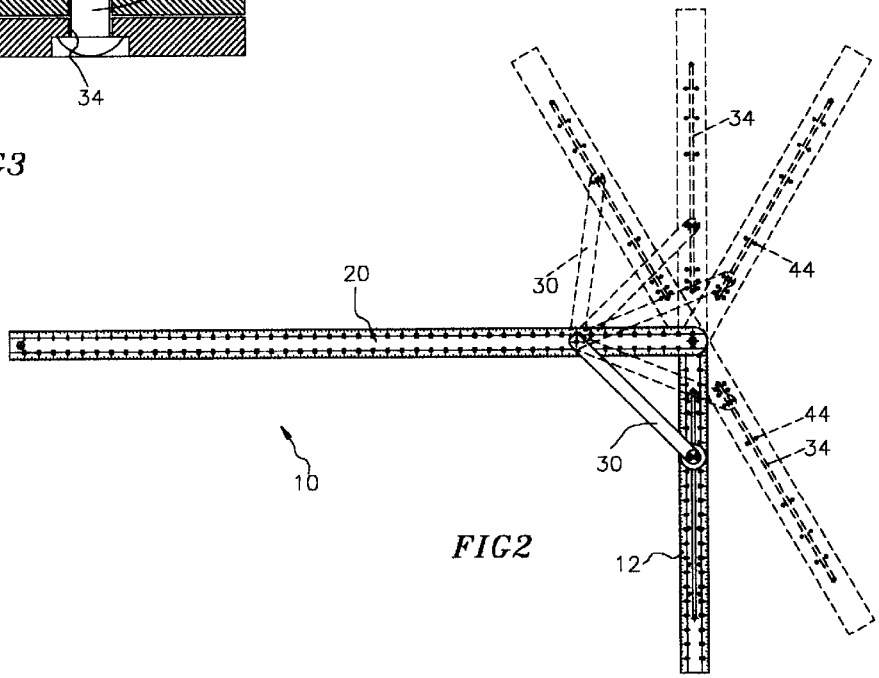
FIG. 2 is a view similar to FIG. 1 but showing in dashed lines the tool adjusted to a plurality of adjusted selected angular positions.

With reference to the drawings, a tool 10 made in accordance with the invention is shown in FIGS. 1 and 2 and comprises a first elongated leg 12 having a first distal end portion 14 and a second opposite distal end portion 16 with its first distal end portion pivotably attached at 18 to the first distal end portion 22 of a second elongated leg 20. Leg 12 is formed with a straight edge 24 extending on at least one, and preferably both sides between distal end portions 14,16. Leg 20 is also formed with a straight edge 26 on at least one, and preferably both opposite sides between distal end portions 22,28 respectively. Preferably conventional measurement marks (not shown) are provided along the straight edges of the legs.

Figure 3:
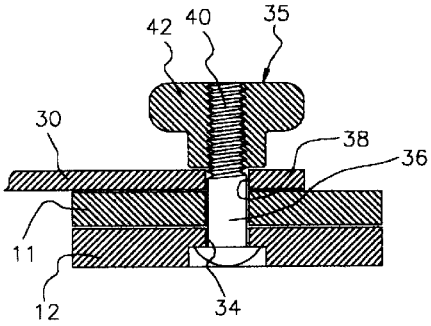
FIG. 3 is a broken away cross sectional view of a locking mechanism used with the FIG. 1 tool.

A connecting link 30 has one end thereof pivotably attached to leg 20 at 32 intermediate the first and second end portions 22,28 respectively, and a second opposite end slidably coupled to leg 12. Leg 12 is formed with a slot 34 which extends parallel to the longitudinal axis of leg 12, i.e., parallel to an imaginary line connecting first and second end portions 14,16. As shown, slot 34 extends substantially the entire length of leg 12 between distal end portions 14,16, however, the specific extremities of the slot will depend on the length selected for connecting link 30 and leg 12 as well as the location of pivot 32. As seen in FIG. 3, a pin member 36 is received through a bore 38 of connecting link 30 and through a spacing washer 11 and slot 34 in leg 12. A locking means 35 comprises a threaded portion 40 on pin 36 which receives a retainer element, such as wing nut 42, so that connector link 30 can be locked at any selected position along the slot 34 by tightening nut 42 to apply a binding force between connector link 30 and leg 12. If desired, optional levels 48,50 may be built into leg 12 to provide a vertical and horizontal reference. Although not shown, suitable low friction washers can be placed between respective movable parts at pivots 18 and 32 and between legs 12 and 20 at pin member 36 to prevent binding of the parts.

According to a feature of the invention indexing means is provided for providing one or more angular positions of leg 12 relative to leg 20 corresponding to selected angles which are frequently used. For example, as best seen in FIG. 2, an indent 44 is provided in leg 12 in communication with slot 34 to receive pin member 36 at a location wherein legs 12 and 20 form a 90 degree angle with one another. It will be appreciated that the particular number of indents and the corresponding angles are a matter of choice. Preferably the length of legs 12,20 are chosen so that they extend over a significant portion of the length and width of standard sheets of building material which typically are four by eight feet. A length A of four feet for leg 20 and a length B of two feet have been found to be effective.

Figure 4:
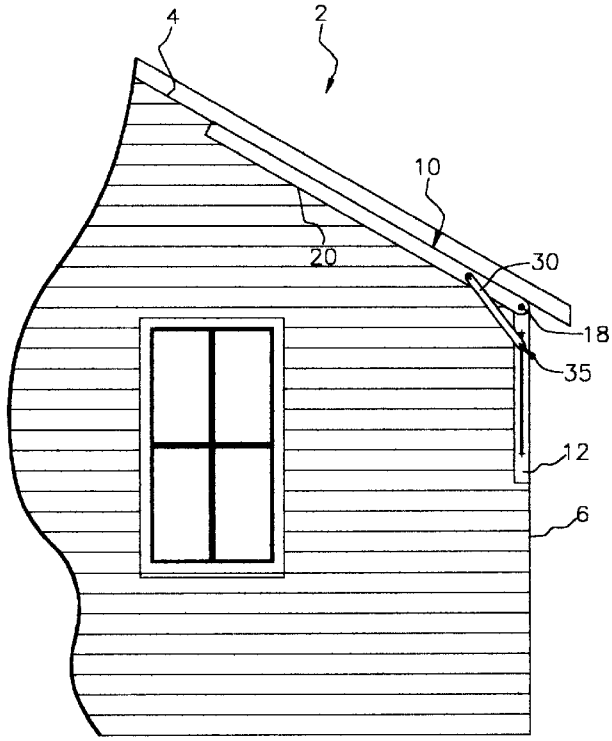
FIG. 4 is a front elevational view of a portion of a building showing the tool placed along the roof-line of the building.
Figure 5:
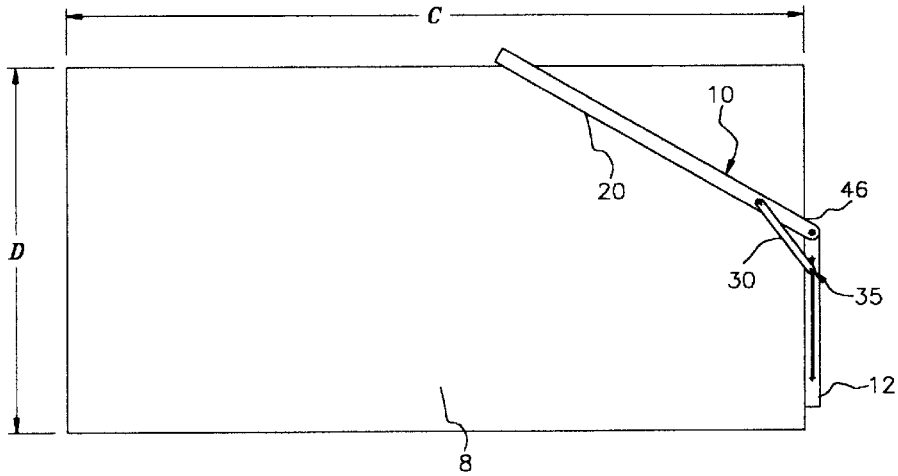
FIG. 5 is a top plan view of the tool placed on a piece of plywood or the like with the elongated legs of the tool fixed at a position corresponding to the FIG. 4 angle of the roof-line.

In use, as seen in FIG. 4, tool 10 is placed at a desired locus, for example when used for marking plywood sheets to be attached to frame members of a house 2 along roof-line 4, leg 12 is positioned so that it is in alignment with a vertical member, for example as indicated at 6, or by use of level 48 (FIG. 1) or a plumb line (not shown), while leg 20 is pivoted until it is aligned with the roof-line. Lock 35 is tightened at this position and then tool 10 can be placed on a piece of building material, such as sheet 8 having a length C of eight feet and a width D of four feet with leg 12 butted up against an end of sheet 8 and leg 20 extending on the surface of the sheet along the same angle as that of the roof-line. The position of tool 10 along the width D of sheet 8 is determined by measuring the vertical height of the opening at only one of the extremities of the mark, e.g., the point corresponding to point 46 on sheet 8. The piece can then be cut and tool 10 can be moved from one sheer to another consistently providing the same selected angle.

Figure 6:
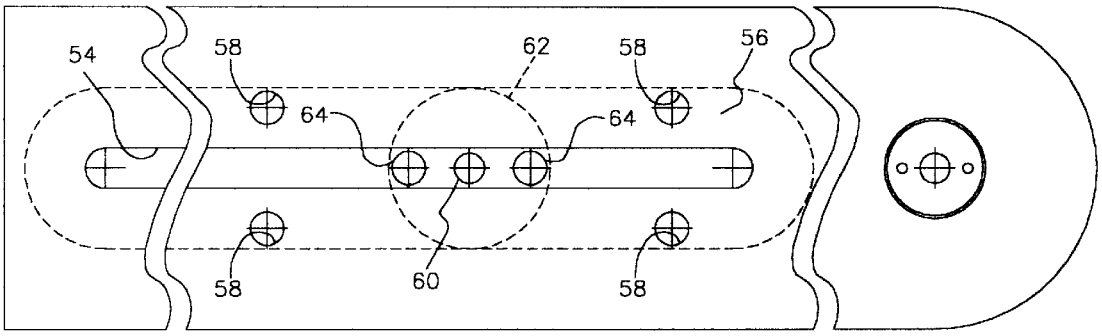
FIG. 6 is a bottom plan view of one leg of an alternative embodiment shown with a locking mechanism in cross-section.
Figure 7:
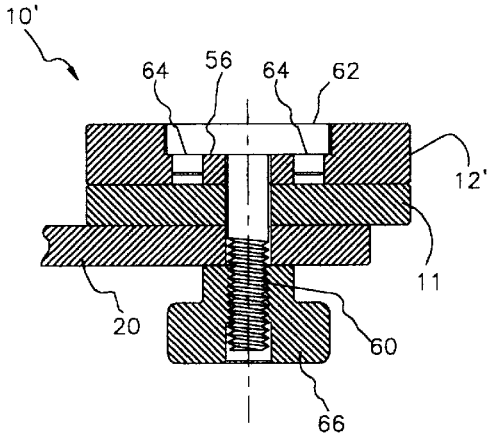
FIG. 7 is a cross sectional view taken through a tool made in accordance with the alternative embodiment.

With reference to the bottom view of FIGS. 6 and 7, an alternate embodiment 10' comprises a modified leg 12' having a slot 54 with an elongated recess portion 56 provided with pairs of bores spaced along the length of slot 54 at locations corresponding to selected angles. Elongated pin member 60 is provided with a head portion 62 which is slidingly received in recess portion 56 and is provided with a pair of downwardly extending pins 64 (as seen in the drawings) spaced apart from one another the same distance as the distance between bores 58 of each pair. Elongated pin member 60 is threaded and receives thereon a nut 66. When nut 66 is loosened head 62 can be positioned so that pins 64 are aligned with the longitudinal axis of slot 54 and moved along the slot to any selected position and then nut 66 can be tightened in the selected position. Alternatively, when nut 66 is sufficiently loose the head can be moved to any one of the pairs of bores 58 and head 62 can be moved away from the bottom wall of recess 56 and rotated so that pins 64 are in alignment with and received in the selected pair of bores 58 so that leg 20 will form a given angle with leg 12'. The nut is again tightened and the tool can then be used with the legs fixed to one another at that angle.

Figure 8:
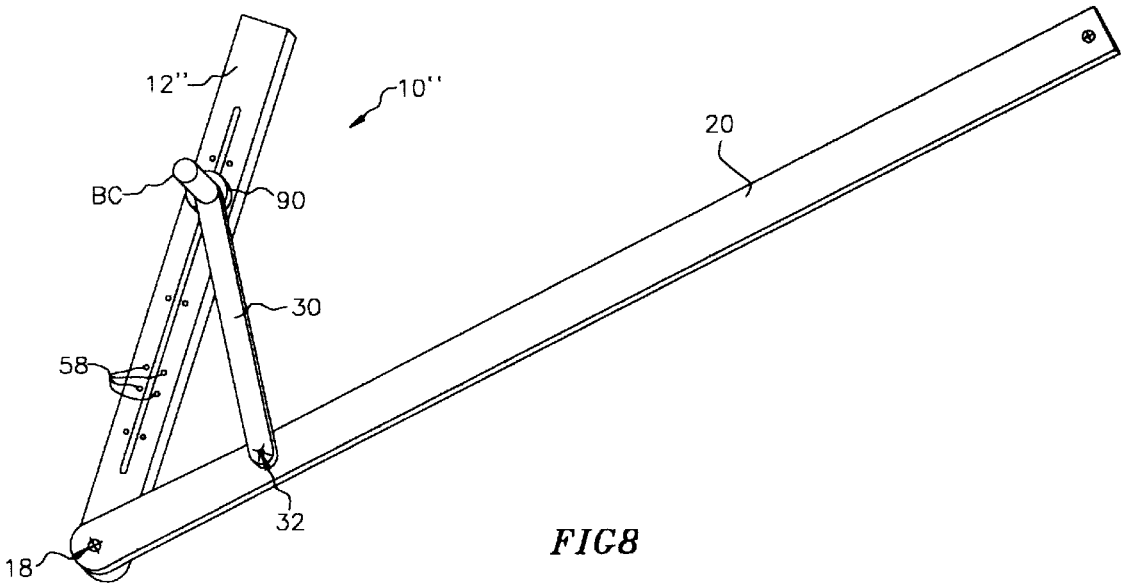
FIG. 8 is a perspective view of a modified FIGS. 6,7 embodiment.
Figure 9:
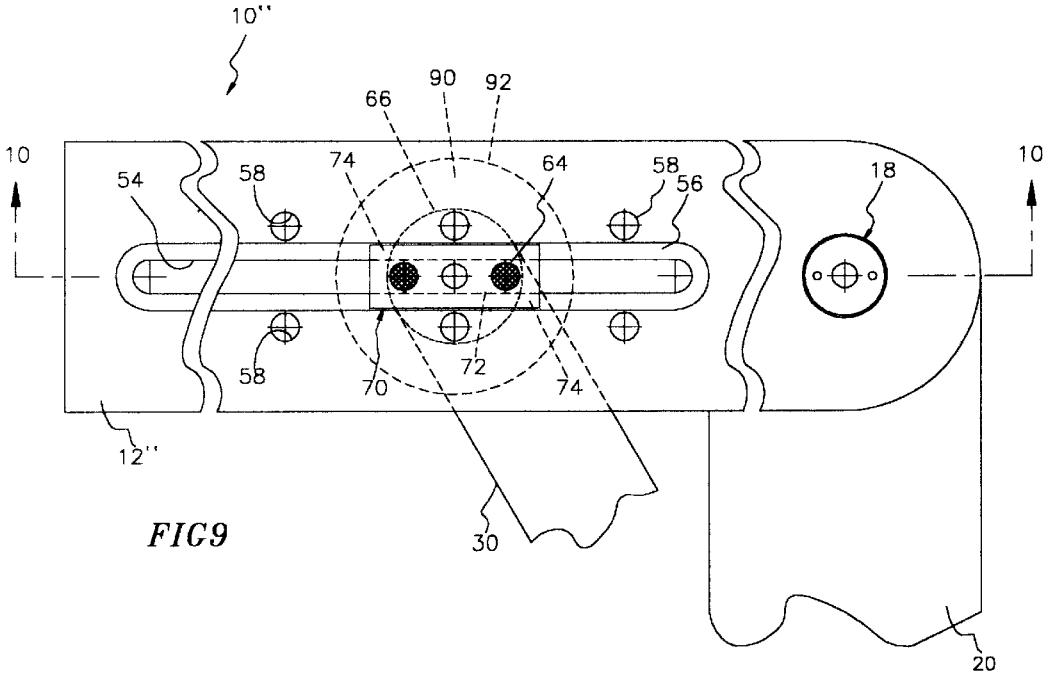
FIG. 9 is a bottom plan view, broken away, of the FIG. 8 embodiment.
Figure 10:
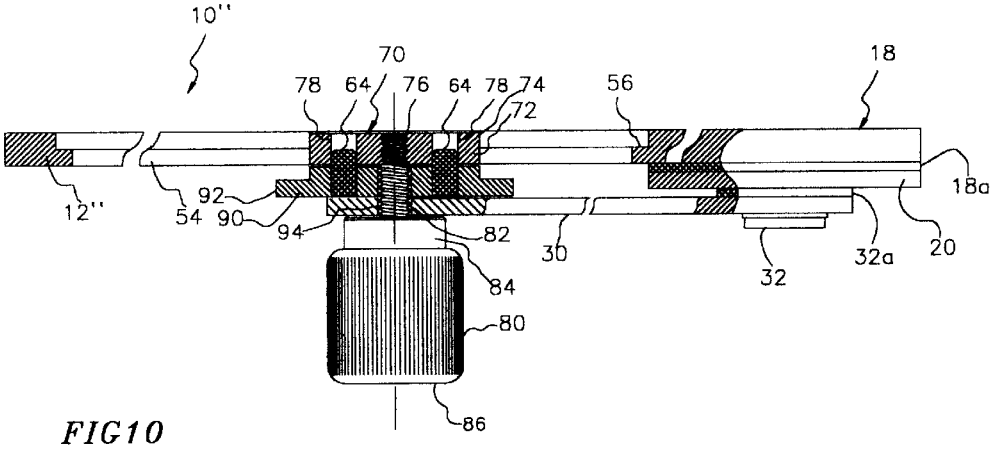
FIG. 10 is a cross sectional view taken on line 10—10 of FIG. 9.

A modified embodiment of the FIGS. 6,7 embodiment is shown in FIGS. 8–10. First leg 12", has recessed portion 56 facing upwardly as seen in the bottom plan view of FIG. 9 with a sliding T-nut 70 having a first part 72 receivable in slot 54 and spaced second parts 74 which are received in recess portion 56. Sliding T-nut 70 is provided with a pair of bores 78 spaced apart a distance equal to the spacing of bores 58 of each pair. A locking knob 80 has a locking stud 82 extending through bores in connecting link 30 and circular index plate 90. Sud 82 has a first inner threaded portion and a second, different distal threaded portion with the second, distal portion received in threaded bore 76 in T-nut 70. Index plate 90 is preferably provided with a knurled outer circumferential edge 92 and has a pair of pins 64 extending therefrom spaced apart to be receivable in bores 58/78. The pivotal connections at 18 and 32 are preferably provided with low friction washers 18*a*, 32*a*, respectively, of suitable material. Locking stud 82 has a head with a hexagonal recess or the like (not shown) which is accessible through an opening in locking knob 80 at distal portion 86 facilitating connection with threaded bore 76 in T-nut 70. The first inner threaded portion is threadingly received through a theaded bore in a base portion 84 of knob 80, allowing knob 80 to be brought into a tight locking engagement with connecting link 30, index plate 90 and T-nut 70. Tool 12" can be adjusted to any desired angle merely by loosening locking knob 80 with pins 64 received in bores 78 of T-nut 70 as shown in FIGS. 9,10 with the T-nut slidable along slot 54 and knob 80 being tightened when the desired angle is obtained. Adjustment of the tool using the indexing bores 58 is effected by loosening locking knob 80, moving legs 12", 20 relative to one another until the appropriate angle is obtained, withdrawing index plate and pins 64 from bores 78 in T-nut 70 and turning index plate 90 approximately 90 degrees by means of the knurled circumference 92 so that pins 64 will be aligned with the selected pair of bores 58 and finally tightening locking knob 80 with pins 64 received in bores 58.

Although the invention has been described with regard to a certain preferred embodiment thereof, variations and modifications will become apparent to those skilled in the art. It is, therefore, the intention that the appended claims be interpreted as broadly as possible in view of the prior art to include all such variations and modifications.

What is claimed:

1. Apparatus for use in applying a line on building material pieces at a reproducible, adjustable angle comprising first and second elongated legs each having a top, a bottom, and side surfaces, and each having a longitudinal axis located generally equidistant between the side surfaces and a length extending between first and second distal end portions and having a straight edge formed along essentially the entire length of each leg, the first portion of each leg pivotably connected to each other, the first distal end portions of the first and second elongated legs each having a circular configuration;

a slot formed in the first elongated leg along at least a portion of the length of the first elongated leg between the first and the second distal end portions thereof;

a connecting link having first and second ends, the first end of the connecting link pivotably attached to the second elongated leg at an axis intermediate to the first and second distal end portions thereof, the second end of the connecting link being movably attached to the first elongated leg and being slidable along the slot, the connecting link received on the top surface of the first and second elongated legs, the circular configuration of the first and second elongated legs having a center of curvature which lies on the axis of the pivotable connection;

indexing means formed on the first elongated leg corresponding to at least one selected angle, the indexing means comprising a pair of bores formed in the first elongated leg on opposed sides of the slot at a selected location for each selected angle and the means for fixing the second end of the connecting link to the first elongated leg comprises a threaded member having a head with a pair of depending pins receivable in the pair of bores; and means to fix the second end of the connecting link to the first elongated leg at any selected location along the slot.

2. Apparatus according to claim 1 in which the means for fixing the second end of the connecting link to the first elongated leg comprises a threaded member extending from the second end of the connecting link and received through the slot and a retainer having a threaded bore received on the threaded member and being screwed against the first elongated leg to lock the connecting link and first elongated leg together at a selected fixed location.

3. Apparatus according to claim 2 in which the second elongated leg has a length of approximately four feet.

4. Apparatus according to claim 3 in which the first elongated leg has a length of approximately two feet and the slot extends between locations closely adjacent to the first and second distal portions thereof.

* * * * *